US005535828A

United States Patent [19]

der Kinderen et al.

[11] Patent Number: 5,535,828

[45] Date of Patent: Jul. 16, 1996

[54] WELLBORE SYSTEM WITH RETRIEVABLE VALVE BODY

[75] Inventors: Wilhelmus J. G. J. der Kinderen; Stanislaus J. C. H. M. Van Gisbergen, both of GD Rijiswijk, Netherlands

[73] Assignee: Shell Oil Company, Houston, Tex.

[21] Appl. No.: 394,530

[22] Filed: Feb. 17, 1995

[30] Foreign Application Priority Data

Feb. 18, 1994 [EP] European Pat. Off. ..... 94200448

[51] Int. Cl.[6] ..... E21B 43/00

[52] U.S. Cl. ..... 166/372; 166/66.4; 166/374; 166/241.5

[58] Field of Search ..... 166/65.1, 66, 66.4, 166/372–374, 241.5

[56] References Cited

U.S. PATENT DOCUMENTS

| | | | |
|---|---|---|---|
| 3,654,949 | 1/1971 | McMurry | 137/155 |
| 3,665,955 | 5/1972 | Conner | 166/117.5 X |
| 3,994,339 | 11/1976 | Goode et al. | 166/117.5 |
| 4,035,103 | 4/1975 | McMurry et al. | 417/109 |
| 4,191,248 | 1/1978 | Heubsch et al. | 166/65 M |
| 4,580,761 | 6/1986 | Silcox et al. | 251/129.11 |
| 4,667,736 | 5/1987 | Rumbaugh et al. | 166/117.5 X |
| 4,682,656 | 6/1986 | Waters | 166/372 |
| 4,846,269 | 7/1989 | Schnatzmeyer | 166/117.5 X |
| 4,852,648 | 8/1989 | Akkerman et al. | 166/66.4 |
| 4,886,114 | 12/1989 | Perkins et al. | 166/66.4 X |
| 4,971,160 | 11/1990 | Upchurch | 175/4.54 |
| 4,981,173 | 1/1991 | Perkins et al. | 166/66.4 |
| 5,008,664 | 4/1991 | More et al. | 340/854 |
| 5,050,675 | 9/1991 | Upchurch | 166/250 |
| 5,052,941 | 10/1991 | Hernandez-Marti et al. | 439/194 |
| 5,070,595 | 10/1991 | Perkins et al. | 166/66.4 X |
| 5,176,220 | 10/1991 | Akkerman | 166/321 |
| 5,425,425 | 6/1995 | Bankston et al. | 166/377 |

FOREIGN PATENT DOCUMENTS

| | | |
|---|---|---|
| 299863A2 | 1/1989 | European Pat. Off. . |
| 2186743 | 2/1986 | United Kingdom . |
| 2233014 | 6/1990 | United Kingdom . |
| 2250320 | 10/1991 | United Kingdom . |
| 2264136 | 3/1993 | United Kingdom . |

OTHER PUBLICATIONS

T. R. Wright, Jr. et al., "Offshore Technology Stresses Substance over Show," *World Oil*, No. 1, Houston, Tex., Jul. 1988, pp. 39–45.

M. A. Schnatzmeyer et al, "Development of a Surface–Controlled Electric Gas–Lift Valve," SPE 36553, 68th Annual SPE Technology Conference, Oct. 3–6, 1993, Houston, Texas, pp. 387–399.

*Primary Examiner*—Roger J. Schoeppel

[57] ABSTRACT

A system for inserting injection fluid into a stream of hydrocarbon fluid flowing through a wellbore formed in an earth formation is provided. The system comprises a production conduit for conveying the stream of hydrocarbon fluid through the wellbore to the earth surface, the conduit being provided with at least one valve chamber that is suitable to receive a retrievable valve body therein, the valve body including a valve that is controllable via an electric circuit connected to surface control equipment so as to move the valve between an open position thereof whereby the valve provides fluid communication between the stream and a fluid injection channel extending in the wellbore, and a closed position thereof whereby the valve prevents fluid communication between the stream and the fluid injection channel, wherein the electric circuit comprises an inductive coupler including a primary coil provided within the production conduit and a secondary coil provided within the valve body. The electric circuit comprises an inductive coupler including a primary coil provided at the production conduit and a secondary coil provided at the valve body.

17 Claims, 2 Drawing Sheets

WELLBORE SYSTEM WITH RETRIEVABLE VALVE BODY

FIELD OF THE INVENTION

The present invention relates to a system for inserting injection fluid into a stream of hydrocarbon fluid flowing through a wellbore formed in an earth formation.

BACKGROUND TO THE INVENTION

British patent application No. 2,250,320 discloses a system for inserting injection fluid into a stream of hydrocarbon fluid flowing through a wellbore formed in an earth formation, the system comprising a production conduit for conveying the stream of hydrocarbon fluid through the wellbore to the earth surface, the conduit being provided with at least one valve chamber that is suitable to receive a valve body therein, the valve body including a valve that is controllable via an electric circuit connected to surface control equipment so as to move the valve between an open position thereof whereby the valve provides fluid communication between the stream and the fluid injection channel extending in the wellbore, and a closed position thereof whereby the valve prevents fluid communication between the stream and the fluid injection channel.

The valve body is electrically connected to a surface control system via a conductor attached to the valve body. When maintenance of the valve is required or in case of failure of the valve, the production conduit has to be removed from the wellbore in order to retrieve the valve body from the wellbore. Such a procedure is costly because removing the production conduit from the wellbore is a time consuming procedure during which the production of hydrocarbon fluid from the wellbore is suspended.

It is therefore an object of the invention to provide a wellbore system which overcomes the problems of the known wellbore system.

SUMMARY OF THE INVENTION

In accordance with the invention there is provided a system for the inserting injection fluid into a stream of hydrocarbon fluid flowing from a wellbore formed in an earth formation, the system comprising a production conduit for conveying the stream of hydrocarbon fluid through the wellbore to the earth surface, the conduit being provided with at least one valve chamber that is suitable to receive a retrievable valve body therein, the valve body including a valve that is controllable via an electric circuit connected to surface control equipment so as to move the valve between an open position thereof whereby the valve provides fluid communication between the stream and a fluid injection channel extending in the wellbore, and a closed position thereof whereby the valve prevents fluid communication between the stream and the fluid injection channel, wherein the electric circuit comprises an inductive coupler including a primary coil provided at the production conduit and a secondary coil provided at the valve body.

By the application of the inductive coupler it is achieved that a reliable electric connection is obtained between the electric circuit and the valve body, which coupling allows the valve body to be positioned in the valve chamber and to be retrieved therefrom without removing the production conduit from the wellbore.

The valve body is preferably positionable in the valve chamber and retrievable therefrom by means of a positioning/retrieving means connectable to the valve body and extending to the earth surface, the positioning/retrieving means being, for example, a wireline.

The valve chamber is preferably arranged to allow the valve body to be positioned therein and to be retrieved therefrom by the positioning/retrieving means via the interior of the production conduit.

The system of the present invention preferably includes a production conduit and an electrically operated valve to selectively provide injection fluid to the interior of the production conduit. Such fluid can for example be a chemical additive for the hydrocarbon stream in the production conduit, or lift gas to promote the flow of hydrocarbon in the production conduit. The valve can be controlled from surface in various manners, for example hydraulically or electrically.

The valve body is preferably provided with sensor means for measuring a physical parameter of the stream of hydrocarbon fluid flowing through the production conduit, the sensor means being electrically connected to the surface control equipment via the inductive coupler.

The flow rate of hydrocarbon fluid in the production conduit can be enhanced by injecting a lift gas in the production conduit in order to reduce the weight of the fluid column in the conduit. For such application the valve suitably forms a gas lift valve and the fluid channel forms a gas lift channel for providing pressurized lift gas to the stream of hydrocarbon fluid via the gas lift valve.

Optimal control of lift gas injection into the production conduit can be achieved if the sensor means includes a pressure sensor for measuring a pressure of the stream of hydrocarbon fluid, the pressure sensor being electrically connected to the surface control equipment via the inductive coupler, and the surface control equipment controls the movement of the gas lift valve between the open position and the closed position thereof in response to pressure signals transmitted by the pressure sensor to the surface equipment.

To protect the inductive coupler from damage due to aggressive and abrasive well fluids, at least one of the coils is suitably covered with a protective sheath of stainless steel, preferably stainless steel 316. Suitably both coils are covered with such a protective sheet. The efficiency of the inductive coupler is thus slightly reduced, only in the order of one to two percent.

When injection of fluid into the production conduit is required at different depths, the production conduit is preferably provided with a plurality of valve chambers located at the different depths, each valve chamber being provided with a valve body which is coupled to the surface equipment via an inductive coupler, the primary coils of the inductive couplers remain electrically connected to the surface control equipment via a conductor extending along the production conduit. Thus the inductive couplers remain electrically connected to the surface equipment when one or more valve bodies are removed from their respective valve chambers so that the remaining valves still can be operated.

DESCRIPTION OF A PREFERRED EMBODIMENT OF THE INVENTION

Figure 1:
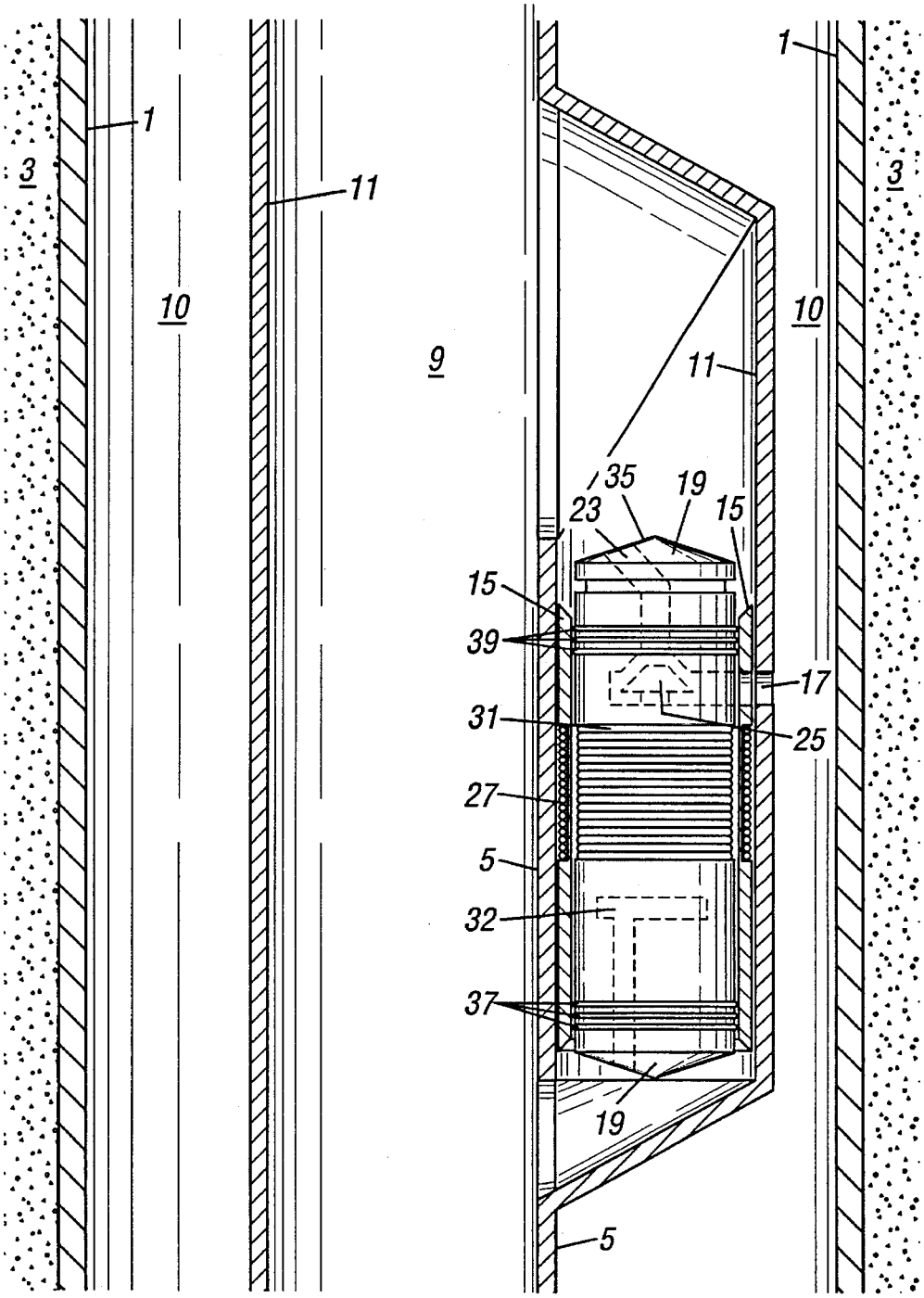
FIG. 1 schematically shows a partial cross-section of a wellbore for the production of hydrocarbon fluid using the system according to the invention.

Referring now to FIG. 1, a wellbore is shown, the wellbore provided with a steel casing 1 cemented to the surrounding earth formation 3 and a production tubing 5 extending longitudinally through the casing 1 between a production zone (not shown) of the earth formation and a wellhead (not shown) in order to convey hydrocarbon fluid through the interior 9 of the production tubing 5 to surface. A space 10 between the casing 1 and the production tubing 5 forms a channel 10 to convey lift gas in downward direction through the wellbore. The production tubing 5 includes a side pocket mandrel 11 of know type, the mandrel 11 having a gas lift valve chamber forming a side pocket 13 arranged aside the interior 9. A tubular element 15 is fixedly located within the side pocket 13, the tubular element 15 having an outer diameter equal to the inner diameter of the side pocket 13. The tubular element 15 and the production tubing 5 are each provided with an opening, the two openings being aligned and forming a lift gas inlet 17.

A cylindrical valve body 19 of outer diameter slightly smaller than the inner diameter of the tubular element 15 is retrievably located within the tubular element 15. The cylindrical valve body 19 can be moved in longitudinal direction thereof through the tubular element 15 and from there can be transferred into the interior 9, or vice versa. The cylindrical valve body 19 is held in place within the tubular element 15 by positioning means (not shown) in a manner that an internal bore 23 of the valve body 19 provides fluid communication between the lift gas inlet 17 and the interior 9 of the production tubing 5. A poppet valve 25 is provided at said bore 23, which valve 25 in an open position thereof allows said fluid communication, and in a closed position thereof prevents such fluid communication. The valve 25 is electrically controllable by electric surface equipment (not shown) via a conductor (not shown) attached to the outer surface of the production tubing 5 and an inductive coupler 27 comprising a primary coil 29 incorporated in the tubular element 15 and a secondary coil 31 attached to the valve body 19. The secondary coil 31 extends around the longitudinal axis of the valve body 19 and the primary coil 29 extends concentrically around the secondary coil 31, both coils 29, 31 being located in a plane substantially perpendicular to the longitudinal axis of the valve body 19. The metal core of the inductive coupler 27 is formed by portions of the production tubing 5, the tubular element 15 and the valve body 19 through which a magnetic flux flows when the inductive coupler is operational. The valve body 19 is furthermore provided with a pressure sensor 33 suitable to measure the pressure in the production tubing 5, which pressure sensor is electrically connected to the electric surface equipment via said inductive coupler 27 and the electric conductor attached to the production tubing 5. The upper portion 35 of the valve body 19 is shaped to allow a wireline tool to be connected to the portion 35 in order to move the valve body 19 through the production tubing 5 by means of a wireline when the wireline tool is connected to said upper portion 35 of the valve body 19. To seal the cylindrical valve body 19 from the tubular element 15 seals 37 are provided around the cylindrical valve body 19 near the lower end thereof, and seals 39 are provided around the cylindrical valve body 19 near the upper end thereof so that the lift gas inlet 17 is sealed from the bore 9 when the valve 25 is in its closed position.

During normal operation of the system of FIG. 1 a wireline operated latching tool (not shown) is positioned within the side pocket mandrel 11, and subsequently the valve body 19 is lowered through the interior 9 of the production tubing 5 by means of a wireline and a wireline tool to which the upper portion 35 of the body 19 is connected. Upon arrival of the valve body 19 in the side pocket mandrel 11 the latching tool guides the valve body 19 into the tubular element 15 located in the side pocket 13 until the valve body 19 is positioned and held in place by the positioning means. In this position of the valve body 19 the bore 23 and the lift gas inlet are aligned, and the primary coil 29 surrounds the secondary coil 31. When lift gas is required in the interior 9 of the production tubing 5 to stimulate hydrocarbon fluid flow therethrough, the valve 25 is electrically opened by electric power transmitted from the surface equipment through the conductor and the inductive coupler 27.

Pressurized lift gas present in the channel 10 then flows via the inlet 17 and the bore 23 into the interior 9 of the production tubing 5. The valve 25 can thereafter be closed by switching off the power or by transmitting a suitable electric signal via the conductor and the inductive coupler 27 to the valve body 19. When pressure measurements in the production tubing 5 are required, pressure signals are transmitted from the pressure sensor 33 via the inductive coupler 27 and the conductor to the electric surface equipment.

When maintenance of the valve body 19 is required, a suitable retrieving tool is lowered by means of a wireline through the interior 9 of the production tubing 5 and connected to the valve body 19. Thereafter the valve body 19 can be pulled to surface by means of the wireline.

Figure 2:
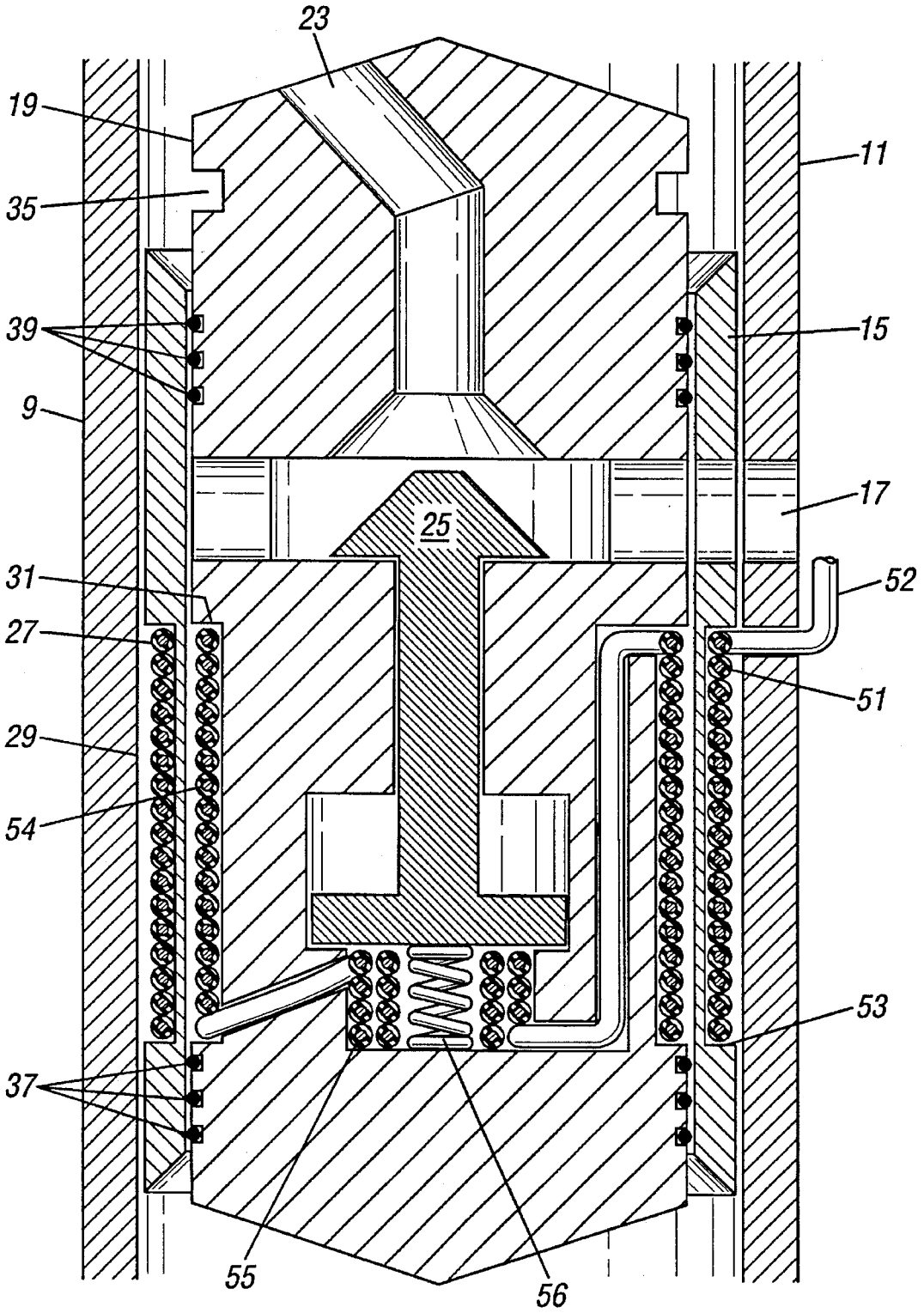
FIG. 2 shows a partial cross-section of the retrievable valve of the present invention placed in a tubular element within the wellbore.

Referring now to FIG. 2, a partial cross-section of the retrievable valve of the present invention 19 is shown placed in a tubular element 15. Elements corresponding to those of FIG. 1 are like-numbered. Passage 17 provides communication from outside the side pocket mandrel 11 to bore 23 through the valve body 19, the bore 23 is controllably blocked by valve 25. A primary coil wire 51 is shown connected to power supply at the surface (not shown) by surface conduit wire 52, and grounded at a terminal end 53 by attachment to the tubular element. The size of the coil wires and insulation surrounding the conductive centers are exaggerated in FIG. 2 in order to conceptually show the invention. In a functional apparatus, the coil wires would be fine wires, considerably more wraps would be employed, and the power supply would be through a more substantial sheathed conduit to the surface. Secondary coil wire 54 provides power, when current is flowing through the primary coil wire, to a magnet coil 55 which, when activated, pulls the valve 25 open, against the force of spring 56, which urges the valve closed. Other means to activate valve 25 by electrical energy provided through the inductive coupler are known, and could be employed in the practice of the present invention.

Although the dimensions of the various components of the system according to the invention can be selected in accordance with operational requirements, implementation of the system according to the invention is particularly attractive if the side pocket mandrel is of conventional type with the gas lift valve chamber forming a side pocket of nominal internal diameter 38.1 mm (1.5 inch). The outer diameter of the primary coil is selected so that the tubular element fits tightly in the side pocket, and the inner diameter of the primary coil is suitably selected to be between 23–27 mm, preferably 25.4 mm (1.0 inch). The secondary coil has an outer diameter selected so that this coil fits within the primary coil, said outer diameter of the secondary coil for example being between 22–26 mm, and preferably being selected so as to allow the secondary coil to fit in a standard 25.4 mm (1.0 inch) wireline tool. The inner diameter of the secondary coil is suitably between 13–17 mm, preferably 15.2 mm (0.6 inch) so that there is sufficient space left within the cylindrical body for electric wiring and the bore. The total length of the inductive coupler can for example be selected between 80–120 mm, preferably 101.6 mm (4 inch) which is small compared to a total length of 457 mm (18 inch) for a typical 1 inch wireline tool.

The materials of the inductive coupler and related components have to withstand downhole pressures and temperatures, and the relative magnetic permeability of the core materials should be sufficiently high, preferably larger than 50, to transmit sufficient power through the inductive coupler. A suitable material for the tubular element in which the primary coil is incorporated has a relative magnetic permeability of between 60–100, preferably L80 steel having a relative permeability of about 80, and a suitable material for the cylindrical body has a relative magnetic permeability of between 500–700, preferably stainless steel 410 having a relative magnetic permeability of about 600. It has been found that optimum power transfer by the inductive coupler is achieved if the electric resistive losses in the windings of the coils and magnetic flux losses in the cores are nearly equal. Therefore, for an output voltage of between 5–15 Volt and a load of about 8 Ohm, optimum efficiency can be obtained by selecting the number of windings of the secondary coil between 250–350, preferably between 290–310, for example 300. The number of windings of the primary coil is mainly determined by requirements on the losses in the electric conductor and the allowed maximum voltage at the surface equipment.

Operation of the valve of the cylindrical valve body suitably requires a power of between 8–12 Watt, for example 10 Watt. In view of this low power requirement the efficiency of the inductive coupler can be relatively low, for example between fifteen and twentfive percent. The output voltage of the inductive coupler is suitably between 5–15 Volt, so that for a load of approximately 10 Ohm the output current can be between 0.5–2.4 Ampere.

An inductive coupler with both coils having 300 turns was tested to determine the efficiency of the coupler as a function of load resistance and frequency for 5 Volt input voltage. It was found that the efficiency increases as a function of the frequency up to 2 kHz at which point a remarkably high efficiency of 60% was reached. The increase of efficiency with frequency is due to the fact that the magnetic losses in the core decrease at increasing frequency. The load at which the maximum efficiency is reached also increases with frequency, which limits the power transfer for frequencies above 2 kHz. Higher frequencies, up to 20 kHz, can be used for data transfer. In an air environment over 15 Watt of power was transmitted at 500 Hz, which is sufficient for most actuators. Because heat transfer is better in a liquid environment than in the air environment, a higher maximum power transfer is possible for downhole applications.

We claim:

1. A system for inserting injection fluid into a stream of hydrocarbon fluid flowing through a wellbore formed in an earth formation, the system comprising a production conduit for conveying the stream of hydrocarbon fluid through the wellbore to the earth surface, the conduit being provided with at least one valve chamber that is suitable to receive a retrievable valve body therein, the valve body including a valve that is controllable via an electric circuit connected to surface control equipment so as to move the valve between an open position thereof whereby the valve provides fluid communication between the stream and a fluid injection channel extending in the wellbore, and a closed position thereof whereby the valve prevents fluid communication between the stream and the fluid injection channel, wherein the electric circuit comprises an inductive coupler including a primary coil provided within the production conduit and a secondary coil provided within the valve body wherein the chamber forms a space enclosed by a tubular element fixedly located within a side pocket on a side pocket mandrel forming part of the production conduit, the primary coil being incorporated in the tubular element.

2. The system of claim 1 wherein the valve body is positionable in the valve chamber and retrievable therefrom by means of a positioning/retrieving means connectable to the valve body and extending to the earth surface.

3. The system of claim 2 wherein the positioning/retrieving means form a wireline.

4. The system of claim 1 wherein the valve chamber is arranged to allow the valve body to be positioned therein and to be retrieved therefrom by the positioning/retrieving means via the interior of the production conduit.

5. The system of claim 1 wherein the secondary coil extends around a longitudinal axis of the valve body and the primary coil extends concentrically around the secondary coil.

6. The system of claim 5 wherein the coils are located in a plane substantially perpendicular to the longitudinal axis of the valve body.

7. The system of claim 5 wherein the valve body is movable within the valve chamber in a direction along the longitudinal axis so as to position the valve in the valve chamber and to retrieve the valve therefrom.

8. The system of claim 1 wherein at least one of the coils is covered with a protective sheath of stainless steel.

9. The system of claim 1 wherein the valve chamber is in fluid communication with the fluid channel via an opening formed in the wall of the production conduit.

10. The system of claim 1 wherein the fluid channel forms an annular space between the production conduit and a casing provided in the borehole.

11. The system of claim 1 wherein the valve forms a gas lift valve and the fluid channel forms a gas lift channel for supplying pressurized lift gas to the stream of hydrocarbon fluid via the gas lift valve.

12. The system of claim 1 wherein the valve body is provided with sensor means for sensing a physical parameter of the stream of hydrocarbon fluid, the sensor means being electrically connected to the surface equipment via the conductive coupler.

13. The system of claim 12 wherein the sensor means includes a pressure sensor for measuring a pressure in the stream of hydrocarbon fluid, and wherein the surface equipment includes a control system that controls opening and closing of the gas lift valve in response to pressure signals transmitted by the pressure sensor to the surface equipment.

14. A system for inserting injection fluid into a stream of hydrocarbon fluid flowing through a wellbore formed in an earth formation, the system comprising a production conduit for conveying the stream of hydrocarbon fluid through the wellbore to the earth surface, the conduit being provided with at least one valve chamber that is suitable to receive a retrievable valve body therein, the valve body including a valve that is controllable via an electric circuit connected to surface control equipment so as to move the valve between an open position thereof whereby the valve provides fluid communication between the stream and a fluid injection channel extending in the wellbore, and a closed position thereof whereby the valve prevents fluid communication between the stream and the fluid injection channel, wherein the electric circuit comprises an inductive coupler including a primary coil provided within the production conduit and a secondary coil provided within the valve body and wherein the valve body is positionable in the valve chamber and retrievable therefrom by means of a wireline effective as a positioning/retrieving means connectable to the valve body and extending to the earth surface and wherein the valve chamber is arranged to allow the valve body to be positioned therein and to be retrieved therefrom by the wireline via the interior of the production conduit, wherein the chamber forms a space enclosed by a tubular element fixedly located within a side pocket on a side pocket mandrel forming part of the production conduit, the primary coil being incorporated in the tubular element.

15. The system of claim 4 wherein the secondary coil extends around a longitudinal axis of the valve body and the primary coil extends concentrically around the secondary coil and wherein the coils are located in a plane substantially perpendicular to the longitudinal axis of the valve body.

16. The system of claim 15 wherein the valve body is movable within the valve chamber in a direction along the longitudinal axis so as to position the valve in the valve chamber and to retrieve the valve therefrom.

17. The system of claim 16 wherein the valve chamber is in fluid communication with the fluid channel via an opening formed in the wall of the production conduit and wherein the fluid channel forms an annular space between the production conduit and a casing provided in the borehole.

* * * * *